US007527007B2

(12) United States Patent
Adamczyk et al.

(10) Patent No.: US 7,527,007 B2
(45) Date of Patent: May 5, 2009

(54) PERSONAL WATERCRAFT

(75) Inventors: Rick Adamczyk, St-Cloud, FL (US); Yves Berthiaume, Mont-Saint-Hilaire (CA)

(73) Assignee: Bombardier Recreational Products Inc., Valcourt (CA)

( * ) Notice: Subject to any disclaimer, the term of this patent is extended or adjusted under 35 U.S.C. 154(b) by 355 days.

(21) Appl. No.: 11/261,646

(22) Filed: Oct. 31, 2005

(65) Prior Publication Data

US 2006/0102064 A1 May 18, 2006

Related U.S. Application Data

(60) Provisional application No. 60/623,235, filed on Nov. 1, 2004.

(51) Int. Cl.
*B63B 35/73* (2006.01)
*B63B 17/00* (2006.01)

(52) U.S. Cl. ..... 114/55.57; 114/363

(58) Field of Classification Search ..... 114/363
See application file for complete search history.

(56) References Cited

U.S. PATENT DOCUMENTS

| | | | | |
|---|---|---|---|---|
| 2,286,350 | A | 6/1942 | Drake | |
| 3,394,673 | A | 7/1968 | Hamori | |
| 3,726,249 | A | 4/1973 | Watkins | |
| 3,982,497 | A | 9/1976 | Caron | |
| 4,022,145 | A | 5/1977 | Tindal | |
| 4,526,392 | A | 7/1985 | Berkstresser | |
| 4,893,579 | A | 1/1990 | Kobayashi | |
| 5,101,751 | A | 4/1992 | Kobayashi | |
| 5,218,920 | A | 6/1993 | Kobayashi | |
| 5,237,950 | A | 8/1993 | Abe et al. | |
| 5,320,059 | A | 6/1994 | Ikeda | |
| 5,372,082 | A | 12/1994 | Hattori | |
| 5,449,305 | A | 9/1995 | Kobayashi et al. | |
| 5,501,168 | A | 3/1996 | Zachary | |
| 5,537,948 | A | 7/1996 | Kobayashi | |
| 5,542,862 | A * | 8/1996 | Kobayashi | 440/38 |
| 5,586,921 | A | 12/1996 | Kobayashi et al. | |
| 5,586,922 | A | 12/1996 | Kobayashi et al. | |
| 5,601,462 | A | 2/1997 | Harlow | |
| 5,915,329 | A | 6/1999 | Watkins et al. | |
| 5,964,172 | A | 10/1999 | Ikeda | |
| 5,970,903 | A | 10/1999 | McDonough et al. | |
| 6,135,835 | A | 10/2000 | Lekhtman | |
| 6,145,458 | A * | 11/2000 | Hattori | 114/55.57 |
| 6,158,378 | A | 12/2000 | Tsumiyama et al. | |
| 6,210,242 | B1 | 4/2001 | Howard et al. | |
| 6,561,109 | B1 | 5/2003 | La Muraglia | |
| 6,712,018 | B2 | 3/2004 | Cassell et al. | |
| 6,817,913 | B1 | 11/2004 | Witham | |

(Continued)

*Primary Examiner*—Jesus D Sotelo
(74) *Attorney, Agent, or Firm*—Osler, Hoskin & Harcourt LLP

(57) ABSTRACT

A personal watercraft (PWC) is disclosed that is convertible between a stand-up type watercraft, and at least one of a straddle-type watercraft, a sit-down type watercraft or a kart-type position watercraft. The PWC includes a hull supporting a power source, and a deck, the deck supporting a steering handle support assembly. A kart-type seat assembly is removably supported by the deck, such that the seat assembly can be selectively removed by the user so that the personal watercraft can be operated with and without the kart-type seat assembly.

10 Claims, 8 Drawing Sheets

U.S. PATENT DOCUMENTS 6,880,482 B2 4/2005 Huse
6,890,224 B2 5/2005 McCann
7,004,091 B2 * 2/2006 Adamczyk et al. ..... 114/55.52
7,124,703 B2 10/2006 Richard et al.
2002/0073910 A1 6/2002 Yamada et al.

* cited by examiner

PERSONAL WATERCRAFT

CROSS-REFERENCE TO RELATED APPLICATIONS

This application claims the benefit of priority to U.S. Provisional Application No. 60/623,235, titled PERSONAL WATERCRAFT, filed Nov. 1, 2004, which is incorporated by reference herein in its entirety. This application is related to but does NOT claim priority to U.S. Regular Applications No. 10/427,911, filed May 2, 2003, titled CONVERTIBLE PERSONAL WATERCRAFT, which is incorporated by reference herein in its entirety. This application is also related to but does NOT claim priority to U.S. Regular application Ser. No. 10/913,316, filed Aug. 9, 2004, titled CONVERTIBLE PERSONAL WATERCRAFT, which is incorporated by reference herein in its entirety. This application is also related to but does NOT claim priority to U.S. Regular application Ser. No. 10/913,314, filed Aug. 9, 2004, titled ENGINE COVER WITH AIR INTAKE SYSTEM FOR WATERCRAFT, which is incorporated by reference herein in its entirety. This application is also related to but does NOT claim priority to U.S. Regular application Ser. No. 10/913,317, filed Aug. 9, 2004, titled STANDING SURFACE DOOR FOR STAND-UP PERSONAL WATERCRAFT, which is incorporated by reference herein in its entirety.

BACKGROUND OF THE INVENTION

1. Field of the Invention

This invention relates to a personal watercraft ("PWC"), and more particularly to a PWC that may be operated as kart style sit-down watercraft.

2. Description of the Related Art

Jet powered watercraft have become very popular in recent years for recreational use and for use as transportation in coastal communities. The jet power offers high performance, which improves acceleration, handling and shallow water operation. Accordingly, PWCs, which typically employ jet propulsion, have become common place, especially in resort areas.

There are at least two different types of PWCs that are configured for different driving and riding styles and preferences. For example, a stand-up type PWC is typically configured with a deck that supports a platform. In this configuration, the driver stands on the platform while driving the PWC. Unlike the other types of PWCs, the stand-up type is not equipped with a seat on which the driver can sit. The steering handle on a stand-up type PWC is configured to be adjustable so that drivers of different heights can comfortably steer the watercraft. Stand-up type PWCs tend to be used by drivers who are more athletic and desire high performance. The driver can adjust the center of gravity of the PWC by adjusting his/her position on the platform. Also, the driver can use his/her body to lean into turns more easily.

In contrast, a straddle-type PWC is configured with a deck that supports a straddle-type seat mounted on a pedestal on the deck. The driver sits on top of the seat and places each foot on opposite sides of the seat so as to "straddle" the seat. Many straddle-type PWCs can accommodate more than one rider with a passenger seated behind the driver. The steering handle of a straddle-type PWC is typically configured to be fixed in a pre-determined location at a pre-determined angle. During operation, the straddle-type PWC tends to feel more stable than the stand-up type. This is largely because the center of gravity of the straddle-type PWC is less variable than the center of gravity of a stand-up type PWC since the driver remains more or less in the same position. This appeals to a different type of PWC driver than a typical stand-up driver. An advantage of the straddle-type PWC is that it allows riders to travel over longer distances more comfortably.

Both PWC configurations provide a significant carving effect in water. The driver of the PWC has to resist lateral forces generated by the carving effect. Resistance to the lateral forces can be uncomfortable when the center of gravity of the driver is high on the vehicle. The center of gravity of the rider on a PWC is generally much higher than the waterline. The design of prior art PWC is not made such that the rider can sit low on the rear of the vehicle in a way it is possible to sustain lateral forces without experiencing an exhausting riding experience.

Therefore, there is a need for a PWC providing a riding position allowing the rider to support centrifugal forces more easily by providing a lower center of gravity.

SUMMARY OF THE INVENTION

An aspect of embodiments of the present invention is to provide a kart style watercraft.

Another aspect of embodiments of the present invention is to provide a seat assembly for a PWC that is fully removable.

The invention is directed to a PWC that includes a hull, a deck having a raised pedestal disposed on the hull, a jet propulsion unit supported by the hull, a power source connected to the hull, a steering device disposed on the pedestal operatively connected to the jet propulsion unit for steering the watercraft, a pair of footwells disposed laterally of the pedestal on each side thereof and a bucket seat disposed on the deck rearward of the pedestal supported by the deck, such that the bucket seat can be selectively removed by the user so that the personal watercraft can be operated with and without the bucket seat. The bucket seat assembly releasably connects to the deck via a mechanical fastener.

The invention is also directed to a mechanical fastener on the deck of the PWC comprising an exposed portion substantially at the same level as the upper surface of the deck.

Another aspect of the invention is to provide a misinstalled seat indicator allowing a rider to perceive that the bucket seat is not properly mating with the mechanical fastener.

An aspect of the present invention provides a bucket seat having a back portion and a seat portion, the seat portion being substantially at the same level as the footrests such that a rider operates the watercraft in a position similar to that of a kart.

Another aspect of the present invention provides an adjustable distance between the bucket seat and the footrests.

One aspect of the present invention provides the footrests being in front of the seat portion such that a rider operates the watercraft in a position similar to that of a kart.

A further aspect of the present invention provides a bucket seat suitable for use on a personal watercraft, the seat having a frame, a seat portion disposed on the frame, a backrest portion disposed on the frame, and a portion of the releasable mechanical fastener disposed on the frame and suitable for mating with another portion of the releasable mechanical fastener on the watercraft.

These and other aspects of embodiments of the invention will become apparent when taken in conjunction with the following detailed description and drawings.

BRIEF DESCRIPTION OF THE DRAWINGS

Features of the invention are shown in drawings, which form part of this original disclosure, in which like parts in the figures are labeled with the same reference numbers. Preferred embodiments of the invention will be described in conjunction with the following drawings, in which.

DETAILED DESCRIPTION OF PREFERRED EMBODIMENTS OF THE INVENTION

A kart style personal watercraft refers to a personal watercraft having a sitting position of a driver sitting in a kart as disclosed in U.S. patent application Ser. No. 09/859,410, filed May 18, 2001, titled DIRECT DRIVE ASSEMBLY AND GO-KART CONTAINING SAME.

As described in further details below, the invention comprises a personal watercraft having a base hull and a deck with a bucket seat to receive a rider. The bucket seat has seat portion, a back portion and side portions disposed respectively on each sides of the back portion. The side portions provide lateral support for a rider and the low positioning of the seat on the watercraft lowers the center of gravity.

The kart style personal watercraft can use a bucket seat permanently or removeably attached on the standing surface at the back of the deck to the floor of the watercraft. Alternatively, the bucket seat can be attached on the front pole assembly and to a portion of the deck, or suspended from the front pole assembly or the rear of the deck, to form a suspended design. Alternatively, the bucket seat could have a suspension system. It can be appreciated by someone having knowledge in the art, the PWC could be used in the stand-up type configuration when the removable bucket seat is removed, which is not shown in this particular embodiment.

FIGS. 1-5 show a preferred embodiment of the kart style PWC 10 of the current invention, which is not intended to be limiting but merely representative of the invention.

Figure 1:
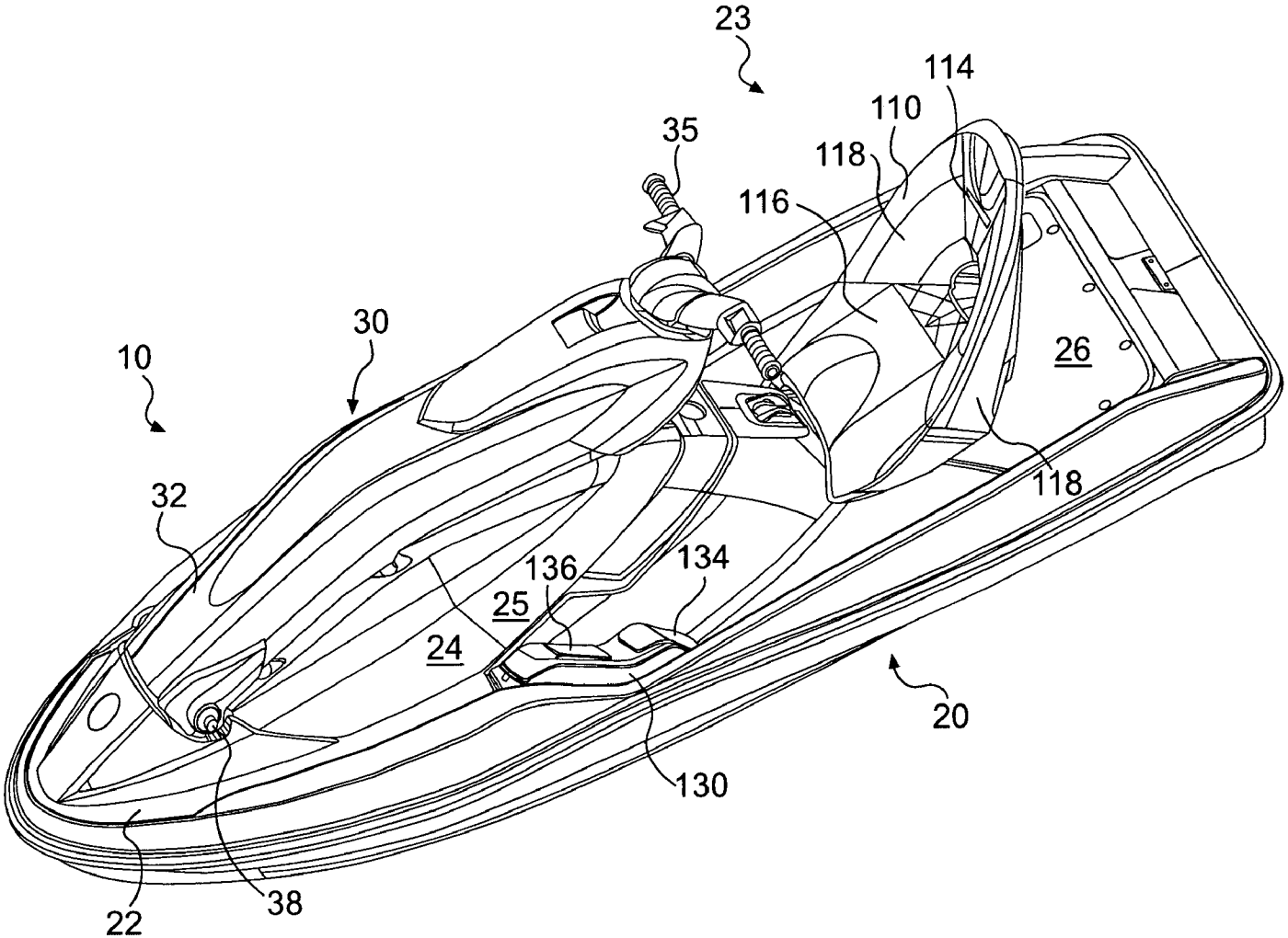
FIG. 1 is a front-left perspective side view of a PWC in accordance with one embodiment of the present invention with a bucket seat connected to the PWC.

FIG. 1 is left-top-right perspective view of the kart style PWC 10. The PWC 10 of FIG. 1 is a watercraft made of two main parts, including a hull 20 and a deck 22. The hull 20 buoyantly supports the PWC 10 in the water and is typically molded from fiberglass material and partially lined internally with buoyant foam material. The hull 20 is shaped and includes a bow or forward hull portion 21 and a stern or rearward hull portion 23. The deck 22 complements the hull 20 and is also typically molded from fiberglass material. The hull 20 and deck 22 are joined together in a sealing relationship at a seam 29, such that no water may enter the space between the hull 20 and the deck 22.

The space between the hull 20 and the deck 22 forms a cavity that accommodates a power source 24, as well as one or more other components. Such other components may include, but are not limited to, a gas tank, an electrical system (battery, electronic control unit, etc.), and other elements required or desirable in the PWC 10. The power source 24 is fixedly disposed, and generally immovable, with respect to the hull forward portion 21 and the deck 22. The power source 24 is preferably a two-stroke engine, such as a Rotax® engine. It is also contemplated that the power source may be a four-stroke engine, other internal combustion engine or an electric motor powered by batteries or fuel cells.

Preferably, the power source 24 is operatively connected to a jet propulsion system (not shown), also supported by the hull 20, that is used to propel the PWC 10. It is contemplated that any jet propulsion system that is designed for a PWC may be used. The specific design of the propulsion system is not vital to the invention, and is therefore not described, though it will commonly be of the water jet type.

As shown in FIG. 1, assuming the bucket seat is removed, the deck 22 is typically shaped and preferably includes a standing platform 26, preferably disposed rearward of the vehicle. The standing platform 26 is preferably flat and sized to accommodate a driver in the stand-up or kneeling position and preferably includes a non-slip surface to allow the driver's feet to remain in place on the platform 26, even when wet. The standing platform extends toward the front of the vehicle on each side of the engine and merges into footwells.

The deck 22 further includes an engine access opening for access to the power source 24 and any other component described above. A hatch 25, or cover, is disposed over the opening and, hence, the power source 24 such that the hatch 25 essentially becomes part of the deck 22 when in the closed position. The hatch 25 may be removably mounted to the deck 22 so that it may be fully removed from the PWC 10. Preferably, the hatch 25 is hingedly attached to the deck 22 such that it may be moved to an open position, yet still remain attached to the deck 22. The hatch 25 preferably includes at least one locking mechanism that ensures that the hatch 25 remains in the closed position when the PWC 10 is in operation. Such locking mechanisms are preferably releasable when suitable force is applied to them by a person.

Figure 2:
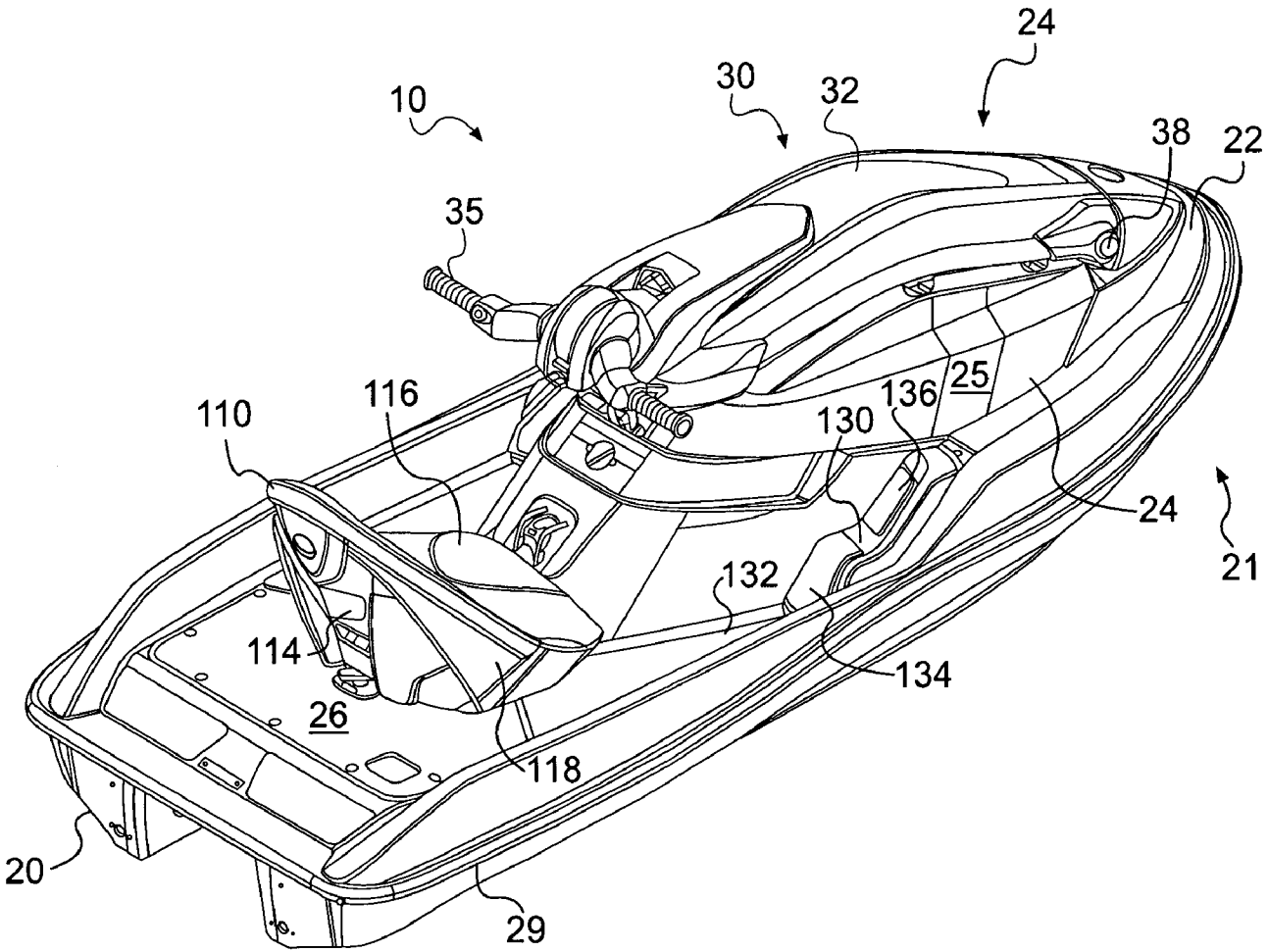
FIG. 2 is a rear-right perspective view of the PWC of FIG. 1 with the bucket seat assembled to the PWC.

A steering handle support assembly 30 is provided on the deck 22 to steer the PWC 10. As shown in FIGS. 1 and 2, the steering handle support assembly 30, or front pole assembly, includes pivotal front support pole 32 that pivot about a horizontal axis at a front attachment point 38 on the deck 22.

In the preferred embodiment, the pole 32 extends from the deck 22 and converge toward each other and end at an operator control center including a steering device support 34. This design provides strength and is adapted for adding and removing components. Alternatively, the front pole 32 may be configured as a single support element with a central open web or cut out. The steering handle support assembly 30 may also be configured to support additional control mechanisms, such as the on/off switch and the throttle or speed control lever.

As shown in the figures, a steering device 35, such as handle bars, is disposed at the end of the steering handle support assembly 30 on the support 34. Other steering devices, such as steering wheels and the like, are also contemplated. Typically, the steering device 35 is operatively connected to a pivotable nozzle (not shown) at the discharge end of the propulsion unit. As the steering device 35 turns, so does the nozzle. As commonly known, this causes thrust created by the propulsion system to be redirected, thereby causing the PWC 10 to turn.

As it can be appreciated on FIGS. 1 and 2, the bucket seat 110 has a back portion 114, a seat portion 116, and side portions 118. The back portion helps support the back of a rider, while the seat portion supports the load of the rider and the side portions help maintain the rider when subjected to lateral forces when riding the vehicle. The bucket seat could include a suspension however, in the present embodiment no suspension is presented. A suspended seat could have many different configurations. The seat could move according to a specific linkage geometry or following the movement of a rail as disclosed on U.S. patent application Ser. No. 10/445,362, filed May 27, 2003, titled VEHICLE SUSPENSION FOR A SEAT THEREOF and assigned to the present assignee. The '362 application is incorporated herein by reference in its entirety. The preferred embodiment uses foams (not shown) to ensure comfort to the rider.

Figure 4:
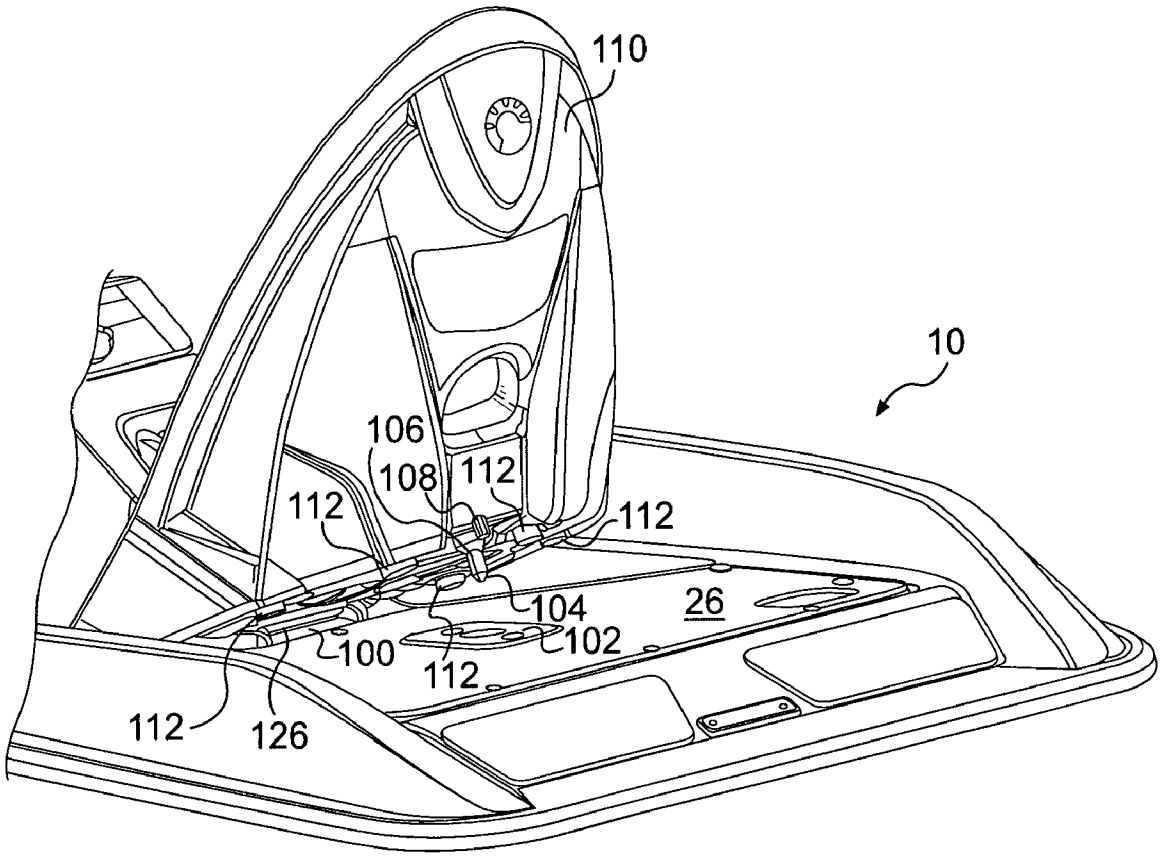
FIG. 4 is a rear-left perspective view of the PWC of FIG. 1 with the bucket seat semi disengaged from the PWC.

FIG. 4 shows an enlarged view of the front mechanical fastener 100 and the rear mechanical fastener 102 for the bucket seat 110. The bucket seat 110 is installed on watercraft 10 by securing the front mechanical fastener 100 first and securing the rear mechanical fastener 102 after.

Figure 3:
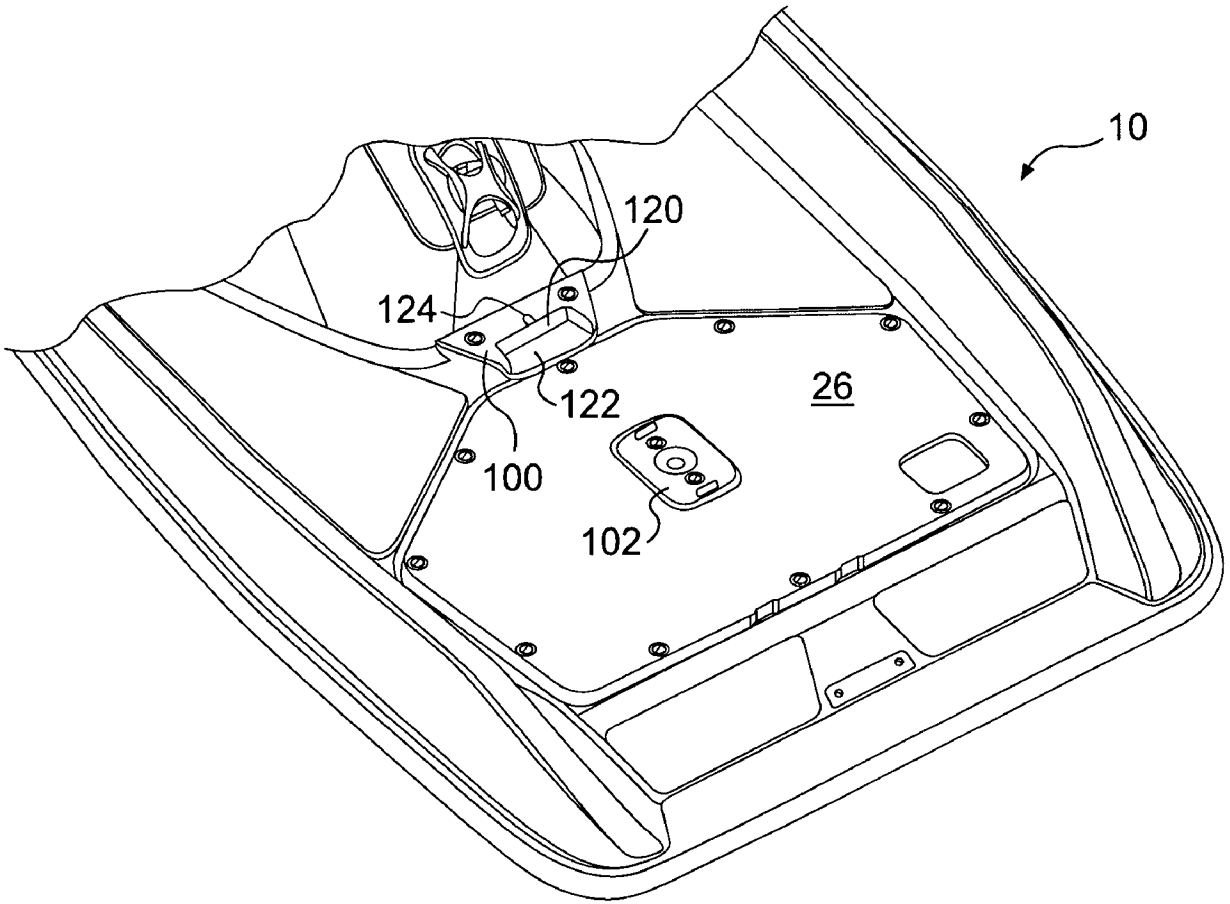
FIG. 3 is a partial rear-left perspective view of the PWC of FIG. 1 with the bucket seat removed from the PWC and the mechanical latch is shown.

FIG. 3 illustrates front mechanical fastener 100 and rear mechanical fastener 102. In the preferred embodiment the front attachment point 100 is designed to have a very low profile to avoid foot injuries. The upper surface of attachment point 100 is substantially coplanar with the standing platform. The long horizontal slot 120 receives a similarly shaped male section 126 disposed to the front-bottom portion of the bucket seat. The male section 126 can slip on flat surface 122 to reach slot 120. When the male section enters slot 120 the seat is fixedly connected on its forward portion.

As illustrated on FIGS. 3 and 4, the rear mechanical fastener 102 includes a female portion mounted on standing platform 26. The exposed portion of the female portion is disposed on the deck at substantially the same level as the adjacent surface of the standing platform to prevent foot injuries. An opening in rear mechanical fastener 102 receives stem 104 connected to seat 110 to secure the seat on standing platform 26. A vertical movement is required to insert the stem 104 in mechanical fastener 102. Still on FIG. 4, an indentation 106 on stem 104 engages a spring loaded pin (not shown) located inside the rear mechanical fastener 102 aperture on the standing platform and is sized and designed to fit the indentation 106. The stem can be disengaged from the spring loaded pin in the rear mechanical fastener 102 by rotating the stem using lever 108. When turning the lever, the indentation in the stem disengages the pin inside the rear mechanical fastener. When the stem is turned the pin exits the indentation and is able to slide on the indentation-free external surface section of the stem.

A plurality of seat supports 112 are provided under seat 110 to ensure stable contact between the seat and the standing platform. The supports 112 are likely to be distributed under the seat on both lateral sides. The supports are made of soft material, likely rubber, to avoid damaging the standing platform surface and to absorb shocks and vibrations.

In order to avoid connecting the rear mechanical fastener 102 when the front mechanical fastener 100 is not properly secured, a protruding pin 124, shown on FIG. 3 is located on top of the front mechanical fastener 100. If the male section 126 is not properly entered in slot 120 and stem 104 is secured in the rear mechanical fastener, the front part of the seat will feel unstable because the flat under portion of male section 126 will be only supported by pin 124 when a rider sits on the seat. This unstable lateral movement warns the rider the front mechanical fastener 100 is not correctly secured (i.e. male section 126 stands on top of protruding pin 124 as opposed as being secured in the slot of front attachment point 100) and should be corrected. Other kind of sensors could be used in connection with the electronic control unit of the vehicle to prevent the vehicle to start if the seat is not correctly attached to the mechanical fasteners.

Figure 7:
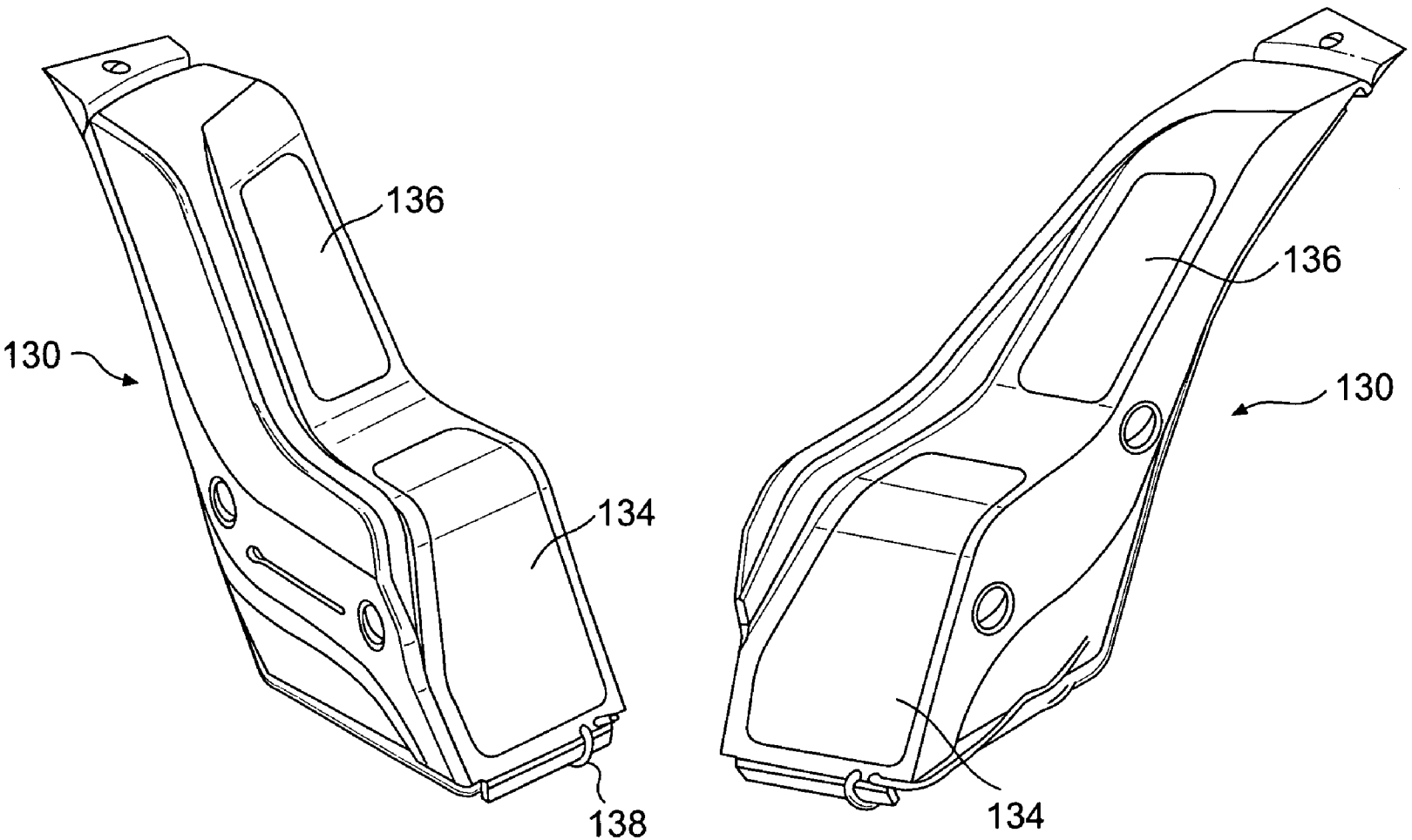
FIG. 7 is a perspective view of an adjustment component that fits in the foot wells of the PWC of FIG. 1.
Figure 8:
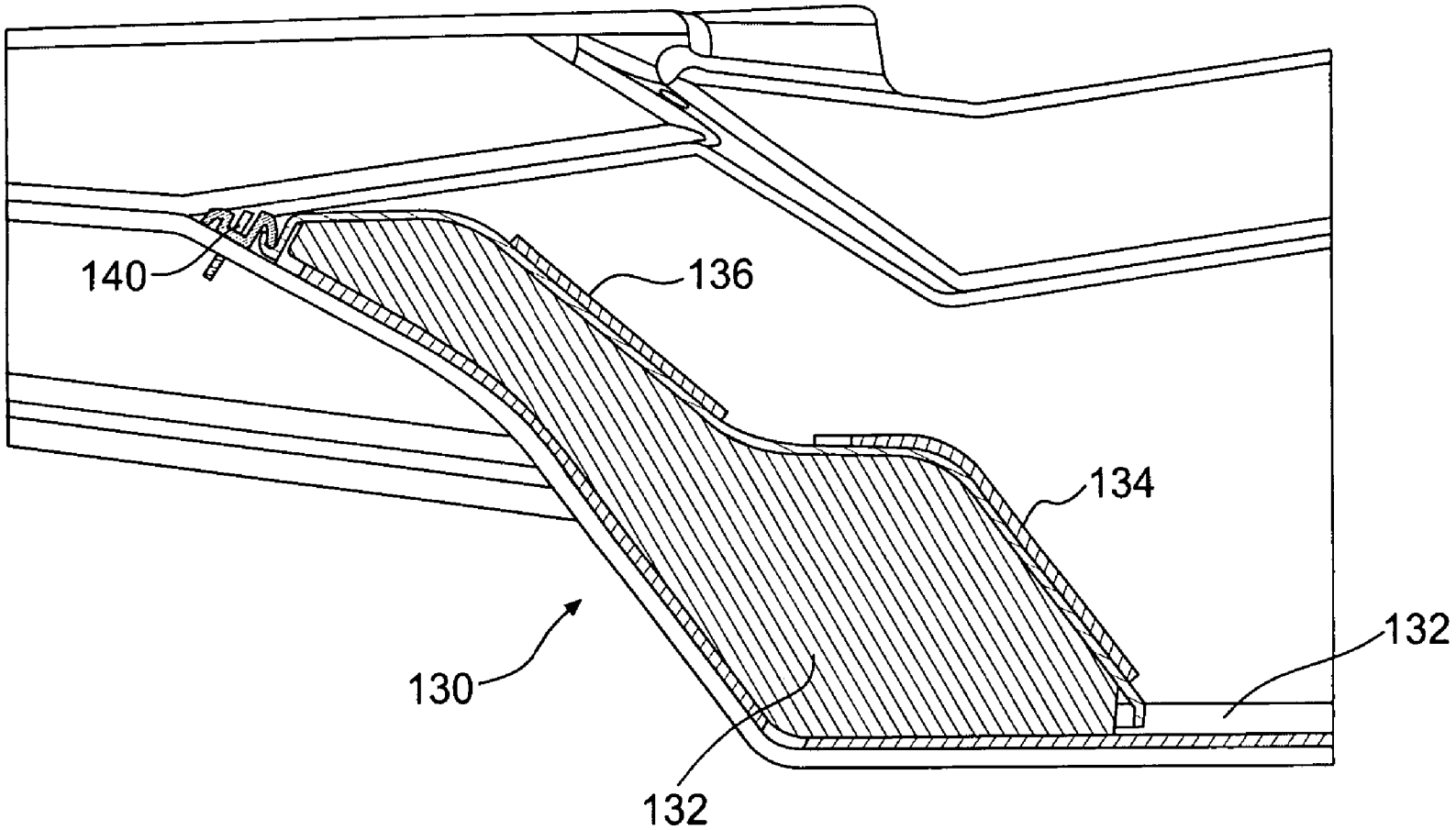
FIG. 8 is a left side cut view of the adjustment mechanism of FIG. 7 in the foot wells of the PWC of FIG. 1.

Foot adjustment sections 130 on FIG. 2 are disposed on top of foot wells 132 to change the distance between the seat 110 and the foot support to accommodate various sizes of drivers. A first portion 134 is closer to the seat, a second portion 136 is disposed a little more toward the front of the vehicle. The rider can put his feet on either the first portion or the second portion depending of the length of his or her legs. The foot adjustment section 130 can be completely removed thus providing a third different distance between the foot wells and the seat. One distance being defined by the foot wells shaped in the deck of the watercraft and the other two distance defined by the foot adjustment sections 130 previously mentioned. The uninstalled foot adjustment sections 130 are seen on FIG. 7. It can also be appreciated a retaining mechanism 138 is provided to secure the rear portion of the foot adjustment section 130 in the foot wells and another retaining mechanism at the front of foot adjustment sections 130. In the present embodiment the front of the foot adjustment section 130 is bolted 140 to the deck of the PWC as illustrated by FIG. 8. The foot adjustment section 130 is likely be made of injected plastic and can include foam or confined sections with air trapped inside to ensure floatation in the event the foot adjustment section 130 would fall in water when using the watercraft.

FIG. 8 presents a cut view of one foot adjustment section 130 in foot well. 132. It can be appreciated a fastener 140 secures the top portion of the foot adjustment section 130. A foam filled 132 foot adjustment section is also illustrated to ensure floatation.

As stated previously, this invention is directed to a kart style personal watercraft that, in some emblodiments, could also be used as a stand-up watercraft when the bucket seat is removed. When used as a stand-up personal watercraft, the steering pole 130 has a pivot axis 38 to raise steering device 35 with hands of the rider standing on the watercraft. The steering pole needs to be moveable for that reason, however, the moving end of the pole needs to be secured to the deck of the watercraft when the watercraft is to be used in the kart position. The rider sits low in the bucket seat 110 and put his or her hands on the steering device 35. The steering device 35 needs to be firmly maintained next to the deck of the PWC to allow the rider to brace himself or herself on the steering device.

Figure 5:
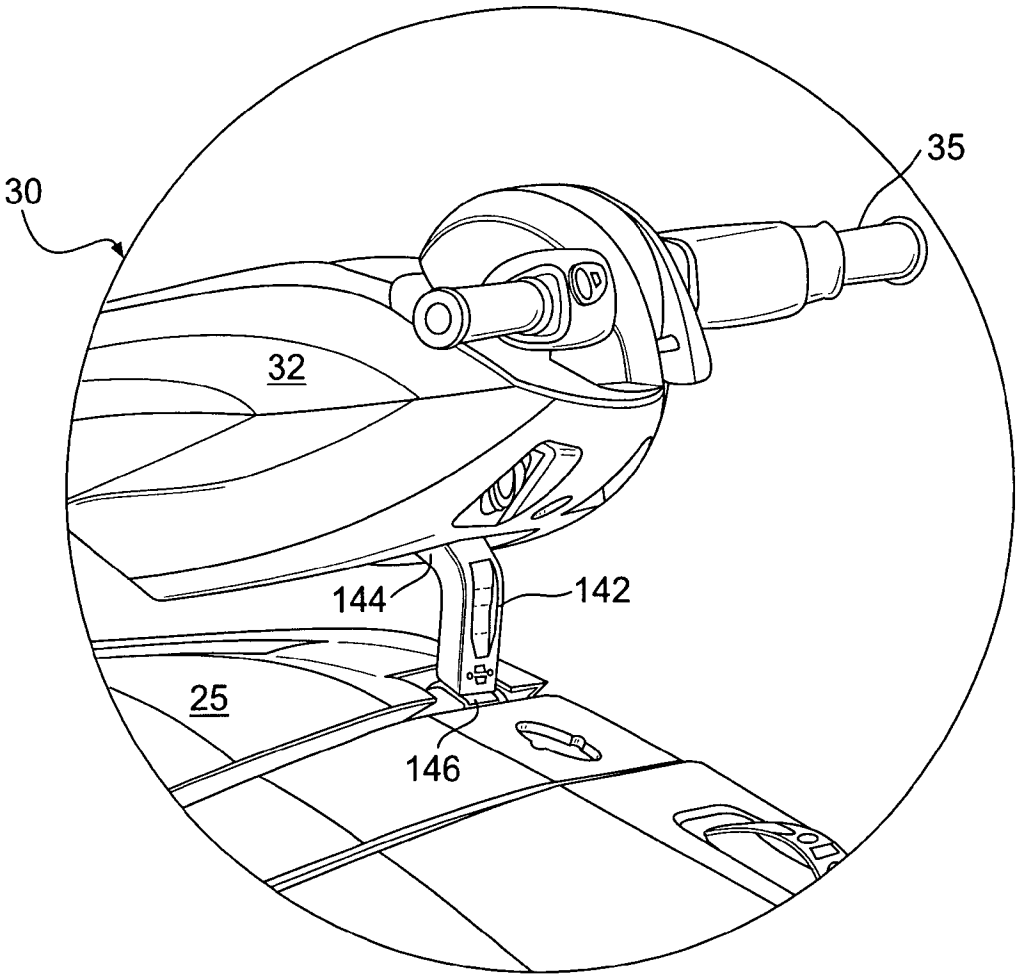
FIG. 5 is left-rear perspective view of the PWC of FIG. 1 with the steering arm connected to the deck of the PWC.

A connector 142 is shown on FIG. 5 to connect steering handle assembly 30 to deck 22 therefore maintaining the pole in a fixed position relative to the deck. Connector 142 can be rotated about axis 144 and stowed within the pole. In the proposed embodiment connector 142 is made of injected plastic and the rotational movement is biased toward the pole to prevent connector 142 to extend outside the pole when not desired. The lower end of connector 142 mates with fastener 146 attached to the deck of the PWC. Fastener 146 is mostly flush with the surface of the deck to avoid any injury when the watercraft is utilized in the stand-up position. The connector 142 can be easily disconnected form the deck. The steering device 35 pivot axis can be pivoted as explained in co-pending U.S. application Ser. No. 10/913,315, filed Aug. 9, 2004 and titled ADJUSTABLE POSITION STEERING assigned to the present assignee is incorporated herein by reference in its entirety. This adjustable steering position improves the ergonomic of the handles considering the rider position is much different between the stand-up riding position and the sit kart-type riding position. The adjustable steering position also provides distance adjustment between the handles and the seat.

Figure 6:
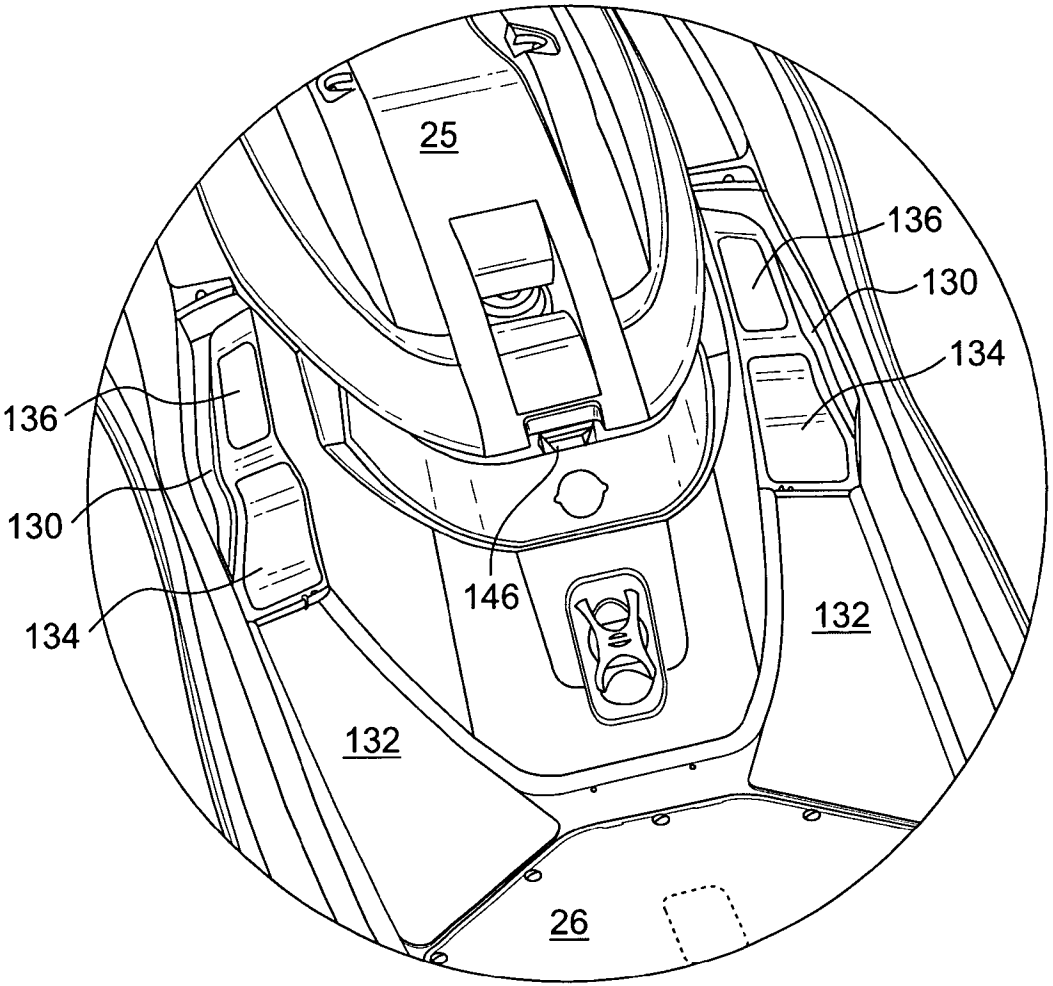
FIG. 6 is a top-rear perspective view of the foot wells of the PWC of FIG. 1.

FIG. 6 depicts a section of the deck where it is possible to connect the connector 142 with fastener 146. Fastener 146 is preferably disposed on the deck of the watercraft instead of on hatch 25 as it is less suitable to bear the weight of the pole than the deck of the PWC.

The description and figures described herein are intended to be illustrative of the invention. It is contemplated that other support configurations and connectors may be used to achieve a similar result and remain within the inventive concept of a PWC with removable components that allow a user to select and modify the type of PWC.

What is claimed is:

1. A personal watercraft comprising a) a hull;

b) a deck disposed on the hull, the deck having a raised pedestal thereon;

c) a jet propulsion unit connected to the hull;

d) a power source supported by the hull and operatively connected to the jet propulsion unit to propel the watercraft;

e) a steering device disposed on the deck, the steering device having handlebars and being operatively connected to the jet propulsion unit for steering the watercraft;

f) a bucket seat disposed on the deck rearward of the pedestal, the seat being removably connected to the deck via a mechanical fastener;

g) a pair of footwells laterally disposed on each side of the pedestal;

h) a pair of footrests, each footrest being located at a forward end of its respective footwell, and each footrest being forward of the steering device; and i) a misinstalled seat indicator.

2. The personal watercraft of claim 1, wherein the mechanical fastener has a exposed portion disposed on the deck at substantially the same level as an adjacent surface of the deck.

3. The personal watercraft of claim 1, wherein the bucket seat further comprises a back portion and a seat portion, the seat portion being positioned relative to the footrests so that a rider can operate the watercraft in a recumbent position.

4. The personal watercraft of claim 1, wherein a distance between the bucket seat and the footrests is adjustable.

5. The personal watercraft of claim 1, wherein a distance between the bucket seat and the steering device is adjustable.

6. The personal watercraft of claim 1, wherein the seat is removably connected to the deck via two mechanical fasteners.

7. A personal watercraft comprising a) a hull;

b) a deck disposed on the hull, the deck having a raised pedestal thereon;

c) a pair of footwells disposed laterally on each side of the pedestal;

d) a jet propulsion unit supported by the hull;

e) a power source supported by the hull and operatively connected to the jet propulsion unit for propelling the watercraft;

f) a steering column pivotably mounted about a horizontal axis at a first end thereof to the deck and pivotable between a raised portion for use by a rider operating the watercraft in a standing position and a low position for use by the rider operating the watercraft in a seated position;

g) a pair of handlebars mounted on a second end of the steering column and operatively connected to the jet propulsion unit for steering the watercraft;

h) a releasable connector for securing the second end of the steering column to the deck when the steering column is in the low position;

i) a standing platform disposed on the deck rearward of the footwells; and j) a bucket seat removeably connected to a surface of the watercraft over a waterline of the watercraft when the watercraft is in water under normal conditions, full of oil and gas, the connection to the surface being made via a mechanical fastener.

8. The personal watercraft of claim 7, wherein the mechanical fastener is substantially flush with the surface of the watercraft.

9. The personal watercraft of claim 7, wherein a distance between the bucket seat and the footrests is adjustable.

10. The personal watercraft of claim 7, wherein a distance between the bucket seat and the handlebars is adjustable.

* * * * *